US010838344B2

(12) United States Patent
Kent et al.

(10) Patent No.: US 10,838,344 B2
(45) Date of Patent: Nov. 17, 2020

(54) SPLICE DETECTION

(71) Applicant: HP Indigo B.V., Amstelveen (NL)

(72) Inventors: Itzik Kent, Ness Ziona (IL); Michel Assenheimer, Ness Ziona (IL); Uri Levy, Ness Ziona (IL); Michael Levy, Ness Ziona (IL); Liran Fanny Haim, Ness Ziona (IL); Maya Bourla-Sadeh, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/463,567

(22) PCT Filed: Feb. 14, 2017

(86) PCT No.: PCT/EP2017/053314
§ 371 (c)(1),
(2) Date: May 23, 2019

(87) PCT Pub. No.: WO2018/149486
PCT Pub. Date: Aug. 23, 2018

(65) Prior Publication Data
US 2019/0377297 A1 Dec. 12, 2019

(51) Int. Cl.
*G03G 15/00* (2006.01)

(52) U.S. Cl.
CPC ..... *G03G 15/652* (2013.01); *G03G 15/5029* (2013.01)

(58) Field of Classification Search
USPC ..... 399/45
See application file for complete search history.

(56) References Cited

U.S. PATENT DOCUMENTS 3,638,568 A * 2/1972 Granger ..... B41F 13/40 101/219
4,314,757 A 2/1982 Anderson et al.
(Continued)

FOREIGN PATENT DOCUMENTS

JP 61064477 4/1986
JP 05297737 11/1993
(Continued)

OTHER PUBLICATIONS

Splice Detection in a Paper Roll, Jun. 16, 2012, <https://www.bannerengineering.com/us/en/solutions/color-mark-and-registration-detection/splice-detection-in-a-paper-roll.html >.
(Continued)

*Primary Examiner* — Quana Grainger
(74) *Attorney, Agent, or Firm* — Trop Pruner & Hu PC

(57) ABSTRACT

Certain examples described herein relate to splice detection. In certain cases, a splice is detected in a web being conveyed towards a transfer member of the printing system. In certain cases, a print frame is identified from a sequence of pending print frames using successive repeat lengths of the sequence and a distance of the splice from the transfer member. The identified print frame is to be transferred from the transfer member across the splice. In certain cases, writing of the identified print frame onto a photo-imaging plate of the printing system is deferred. In certain examples, the web is disengaged from the transfer member following transfer of an image of a print frame preceding the identified print frame. The web is re-engaged with the transfer member so as to transfer an image of the identified print frame to the web from the transfer member after the splice is conveyed beyond the transfer member.

20 Claims, 6 Drawing Sheets

(56) References Cited

U.S. PATENT DOCUMENTS

| | | | | |
|---|---|---|---|---|
| 5,878,320 | A | 3/1999 | Stemmle | |
| 6,520,080 | B1 * | 2/2003 | Fried | B65H 16/106 101/227 |
| 7,277,114 | B2 | 10/2007 | Konagaya | |
| 8,764,154 | B2 | 7/2014 | Sugimura et al. | |
| 2002/0001006 | A1 | 1/2002 | Matsumoto et al. | |
| 2012/0070160 | A1 | 3/2012 | Aoki | |
| 2015/0116395 | A1 | 4/2015 | Schelmbauer | |

FOREIGN PATENT DOCUMENTS

| | | |
|---|---|---|
| JP | 2002046915 | 2/2002 |
| JP | 2015515648 | 5/2015 |
| JP | 2016040135 | 3/2016 |
| JP | 2016175722 | 10/2016 |

OTHER PUBLICATIONS

Web Fed Printing, 2006, < http://www.pepperl-fuchs.com/global/en/19898.htm >.

* cited by examiner

SPLICE DETECTION

BACKGROUND

Some printing systems operate by transferring images onto continuous print media. Continuous print media may be fed from rolls or webs of print media. The images may comprise "inked images", i.e. portions of printing fluid such as ink, that are transferred onto a section of the print media to result in a printed output. The continuous print media may comprise, amongst others, a polymer or paper substrate. Rolls of print media can contain "splices" where separate sections of print media are joined together. The presence of splices in roll-fed print media can introduce non-uniformity which may cause irregularity in the printed output.

BRIEF DESCRIPTION OF THE DRAWINGS

Various features of the present disclosure will be apparent from the detailed description which follows, taken in conjunction with the accompanying drawings, which together illustrate, by way of example, features of the present disclosure, and wherein.

DETAILED DESCRIPTION

Printing systems may be sensitive to thickness or surface property changes in the media upon which images are printed. For example, in web-offset printing systems, a transfer member such as a print blanket may be damaged by a sudden change of media thickness. Such a sudden change of media thickness may be caused by a splice in a roll of continuous print media. A splice or join between separate portions of print media may be formed by an adhesive tape. As well as potential damage to printer components caused by the sudden change in media thickness, images printed onto the adhesive tape of the splice may be unusable or of undesirably low visual quality. In some cases, for example when inked images are to be transferred from a transfer member to a print medium, inked images may fail to transfer onto the adhesive tape of the splice. Inked images remaining on the transfer member may then interfere with subsequent images to be transferred.

A variable data print (VDP) job may comprise printing a sequence of images, where at least some of the images are different from each other and/or have different lengths. The sequence of images in a VDP job may be in a particular pre-configured order for processing and/or printing. The printing of a given image across a splice may not be detected until after the entire print job is completed. Reprinting of the given image may be performed as a result of the splice. This leads to waste of the original image and interruption of the printing process. In some cases, for example in a VDP job, reprinting of the entire image sequence may be performed as a result of the splice.

Figure 1:
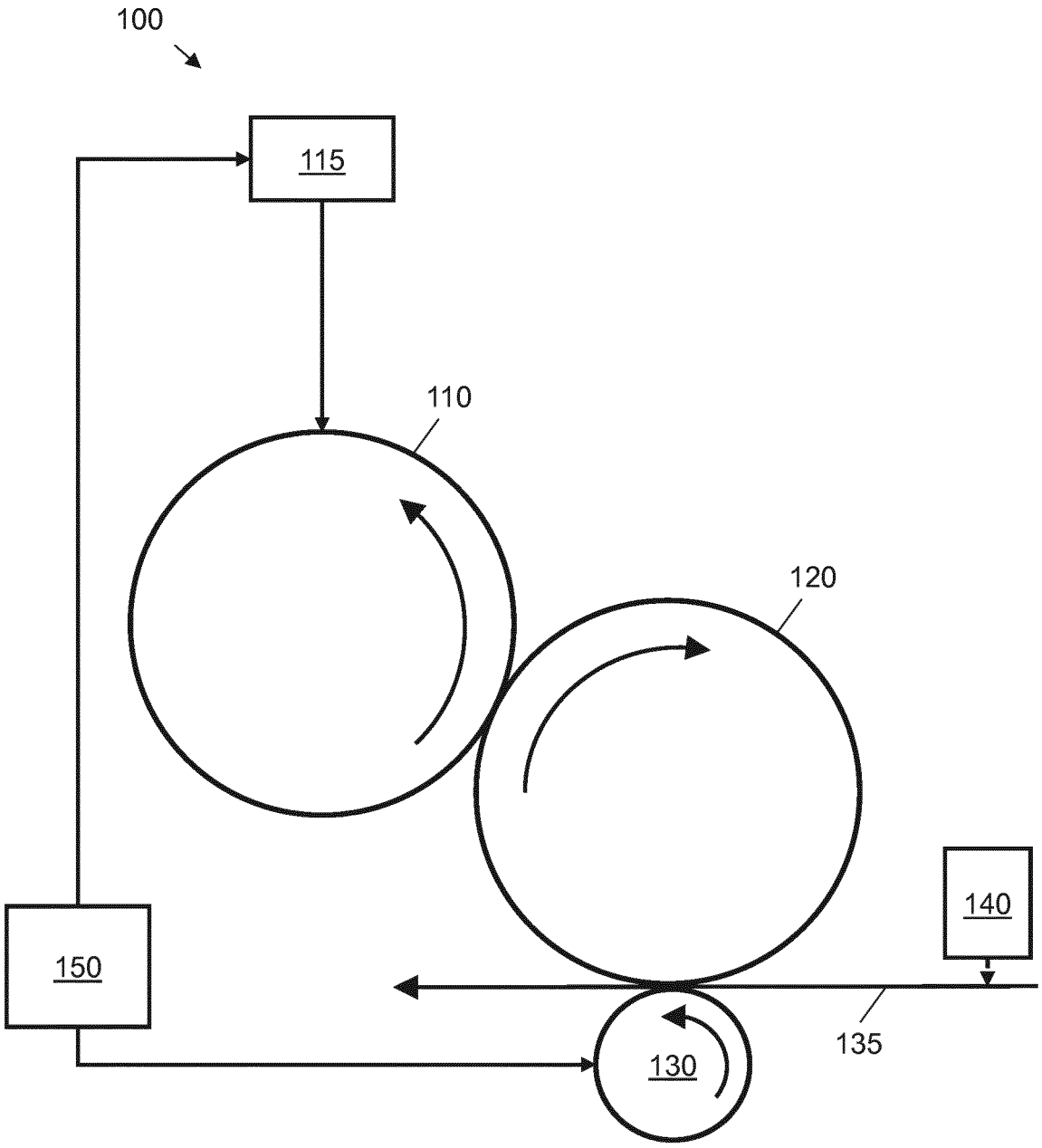
FIG. 1 is a schematic diagram of a printing system according to an example.

FIG. 1 shows a printing system 100 according to an example. The printing system 100 may be a digital press printer. An example of a digital press printer is a digital offset press printer, for example a Liquid Electro-Photographic (LEP) printer. A digital offset printer works by using digitally controlled lasers or LED imaging modules to create a latent image on the charged surface of a photo-imaging cylinder. The lasers are controlled according to digital instructions from a digital image file to create an electrostatic image on the charged photo-imaging cylinder. Ink is then applied to the selectively discharged surface of the photo-imaging cylinder. Ink is then transferred onto the photo-imaging cylinder, creating an inked image. The inked image is then transferred from the photo-imaging cylinder to a heated blanket cylinder, where heating evaporates a liquid vehicle from the ink, and finally from the blanket cylinder to a print medium.

In the example of FIG. 1, the printing system 100 comprises a photo-imaging plate 110. In the present example, the photo-imaging plate 110 is mounted onto a cylinder. The cylinder may comprise a holder for attaching the leading edge of the photo-imaging plate 110. In some examples, the trailing edge of the photo-imaging plate 110 is also attached to the cylinder. In another example, the photo-imaging plate 110 is mounted to a belt comprising a closed loop foil. In the present example, the mounted photo-imaging plate 110 is rotatable about its axis in an anti-clockwise direction. In other examples, the photo imaging plate 110 is rotatable in a clockwise direction. In the present example, the photo-imaging plate 110 may be otherwise referred to as a photo-imaging cylinder.

The printing system 100 also comprises an imaging unit 115. The imaging unit 115 is configured to generate an electrostatic image of a print frame on the photo-imaging plate 110. The imaging unit 115 may comprise a laser imaging unit. In such an example, the photo-imaging plate 110 is electrostatically charged prior to being exposed to digitally controlled lasers of the imaging unit 115. The imaging unit 115 dissipates the static charges on selected portions of the surface of the photo-imaging plate 110 to leave an invisible electrostatic charge pattern that represents an image of the frame to be printed (referred to herein as an "electrostatic image"). Ink is then transferred onto the photo-imaging plate 110 by at least one ink unit (not shown). The ink units may comprise binary ink developer (BID) units, wherein each BID unit supplies ink of a different base color. The ink may contain electrically charged pigment particles which are attracted to the image areas of the photo-imaging plate 110. The ink is repelled from the non-image areas. An inked image of the print frame is therefore present on the photo-imaging plate, i.e. a representation of the image formed from ink.

The printing system 100 also comprises a transfer member 120. In the present example, the transfer member 120 is cylindrical. However, in other examples, the transfer member may be other shapes, e.g. a belt. In the present example, the cylindrical transfer member 120 is rotatable about its axis in a clockwise direction. In other examples, the transfer member 120 is rotatable in an anti-clockwise direction. In an example, the transfer member 120 comprises a blanket wrapped around the surface of the transfer member 120. The transfer member 120 may be otherwise referred to as a blanket cylinder or an intermediate transfer member. The transfer member 120 is arranged to engage with the photo-imaging plate 110. The transfer member 120 is configured to receive an inked image of the print frame from the photo-imaging plate 110. In the present example, the inked image is transferred from the photo-imaging plate 110 to the transfer member 120 by rotating both the photo-imaging plate 110 and the transfer member 120 in opposite directions.

The printing system 100 also comprises a media transport 130. The media transport 130 is configured to move a continuous print medium 135 relative to the transfer member 120 to enable the transfer member 120 to transfer an inked image onto the continuous print medium 135. The media transport 130 is configured to engage with the transfer member 120 to enable the inked image to be transferred from the transfer member 120. In some examples, the media transport 130 comprises one or more rotatable cylinders. The media transport 130 may be otherwise referred to as an impression cylinder. At least one of these rotatable cylinders may be moved towards the transfer member 120 to "engage" the continuous print medium 135 with the transfer member 120. Similar, at least one of the rotatable cylinders may also be moved away from the transfer member 120 to "disengage" the continuous print medium 135 from the transfer member 120. The media transport 130 may additionally or alternatively include feeds, conveyors, platforms and/or trays. The continuous print medium 135 comprises a roll or web of print medium. Different types of print media may be used in the printing system 100. Examples of types of print media include, but are not limited to, papers, synthetics, films, foils, fabrics, flexible cardboard and flexible paperboard. Webs or reels of supporting backing materials may additionally be coated, metalized, colored, transparent, translucent or the like.

In some examples, the media transport 130 and the transfer member 120 are arranged to be separated by a predetermined distance at a nip or gap between the transfer member 120 and the media transport 130. The term "nip" refers to a region in which the media transport 130 and the transfer member 120 are in closest proximity. When the print medium 135 passes through the nip, the distance between the media transport 130 and the transfer member 120 may be adjusted to produce a predefined pressure and/or force on the print medium 135. Such adjustment may be based on a property of the print medium 135, for example a thickness or material of the print medium 135.

In some examples, the media transport 130 is configured to move the print medium 135 in a bidirectional fashion. In other words, the print medium 135 may be conveyed both forwards and backwards by the media transport 130 relative to the transfer member 120. In an example, the print medium 135 is conveyed in a forward direction as an image is transferred onto the print medium 135 from the transfer member 120. Immediately after the image is transferred to the print medium 135, there may be no ink image present on the transfer member 120. For example, the next image in the sequence may still be being written onto the photo-imaging plate 110 and is therefore not ready to be transferred to the print medium 135 via the transfer member 120. In order to obtain a continuous sequence of printed images on the print medium 135, the print medium 135 is conveyed backwards and forwards by the media transport 130 until a point in time when the next inked image may be transferred from the transfer member 120. By moving the print medium 135 in a bidirectional fashion, the print medium 135 may be advanced through the transfer nip at the same velocity for each image in the sequence to be printed, resulting in a more consistent print quality for each printed image compared with a case in which the print medium 135 is moved in a forwards direction and periodically stopped, but not moved in a backwards direction.

To enable forwards and backwards motion of the print medium 135 in an effectively inertia-free manner, print media buffers may be used. Print media buffers cause the length of print media between a print media reel and a transfer nip between the transfer member 120 and the media transport 130 to behave dynamically. The length of print media between the reel and the transfer nip may therefore not be well-defined.

The printing system 100 further comprises a splice detector 140. The splice detector 140 is configured to detect a splice in the continuous print medium. A splice is a physical join between different sections of print medium that together form a continuous roll of print medium. A splice may cause a change in thickness of the roll of print medium 135. A splice may additionally or alternatively cause a change in opacity of the roll of print medium 135. The splice detector 140 comprises a sensor. In an example, the splice detector 140 is configured to detect the splice by detecting the change in thickness of the roll of print medium 135. In another example, the splice detector 140 detects a change in optical properties of the print medium 135, for example a change in the transparency or opacity of the print medium 135. In another example, the splice detector 140 is configured to detect a change in the capacitance of the print medium 135. In an example, the splice detector 140 is an ultrasonic sensor. In another example, the splice detector 140 is a photoelectric sensor. The splice detector 140 may also include detection sensors or differing types.

Splice detection by the splice detector 140 may be affected by the forward and backward motion of the print medium 135. In some examples, the splice detector 140 is configured to detect a splice if the splice is moving towards the transfer member 120, i.e. in one predetermined direction when able to operate bidirectionally. In other words, a splice may be detected if the media transport 130 is moving the print medium 135 in a forward direction relative to the transfer member 120, but not if the media transport 130 is moving the print medium 135 in a backward direction relative to the transfer member 120. The predetermined direction may depend on a configuration of a given printing system.

The printing system 100 also comprises a print processor 150. The print processor 150 is communicatively coupled to the imaging unit 115 and the media transport 130. The print processor 150 is configured to generate control signals for the imaging unit 115 and the media transport 130. In some examples, the print processor 150 is configured to generate control signals for other controllable components of the printing system 100, for example the photo-imaging plate 110, the transfer member 120 and/or the splice detector 140. The print processor 150 may comprise a central processing unit of an embedded computing device, a microprocessor, a suitably-programmed Field Programmable Gate Array (FPGA) and/or an Application-Specific Integrated Circuit. The print processor 150 may obtain instructions from an integrated or separate memory, which may be volatile and/or non-volatile, e.g. instructions may be retrieved from an erasable programmable read-only memory and loaded into a processor cache.

Responsive to detection of a splice by the splice detector 140, the print processor 150 is configured to identify a pending print frame in a sequence of pending print frames based on data indicating successive repeat lengths of the pending print frames. A print frame may correspond to an image in a sequence of images to be printed. A print frame may comprise an image to be printed in addition to boundary and/or margin areas that are to surround the image on the print medium. The repeat length of a given print frame is the distance from a point in the given print frame, for example a leading edge of the given print frame, to the same point in the following print frame, for example a leading edge of the following print frame.

Responsive to detection of a splice by the splice detector 140, the print processor 150 is further configured to send a control signal to the unit 115 to delay generating the electrostatic image for the identified print frame on the photo-imaging plate 110. In an example, for example where the photo-imaging plate 110 is cylindrical, the imaging unit 115 is to delay generating the electrostatic image for the identified print frame while the photo-imaging plate 110 continues to rotate. In an example, writing of at least one color separation onto the photo-imaging plate 110 is delayed. In an example, the print processor 150 is configured to initiate a null cycle of the photo-imaging plate 110, during which no image data is written onto the photo-imaging plate 110. The duration of the null cycle may correspond to a duration of writing a color separation onto the photo-imaging plate 110. In a null cycle, otherwise referred to as an "idle cycle", components of the printing system 100 may be kept as close as possible to a printing state so that printing may be resumed promptly when the null cycle is complete.

The print processor 150 is further configured to send a control signal to the media transport 130 to temporarily disengage from the transfer member 120 following transfer of an image of a print frame preceding the identified print frame and to advance the print medium 135 by a predetermined distance. In an example, the predetermined distance is a repeat length of the identified print frame. In another example, the predetermined distance is a sum of successive repeat lengths of at least two print frames in the sequence. This may then allow downstream finishing equipment to properly process the web. For example, finishing equipment may be instructed to skip media processing for an empty print frame equivalent to the identified print frame. In a further example, the predetermined distance is a determined width of a splicing tape. By advancing the print medium 135 by a distance corresponding to the width of the splicing tape, wastage of print media may be reduced.

Disengaging the media transport 130 from the transfer member 120 may comprise bringing the print medium 135 out of physical or near-physical contact with the transfer member 120. The print processor 150 may be configured to send a further control signal to the media transport 130 to re-engage with the transfer member 120 after the splice has been conveyed beyond the transfer member 120. In one example, the media transport 130 is configured to temporarily disengage the print medium 135 from the transfer member 120, e.g. disengage for a predetermined period of time. This period of time may be based on the null cycle of the photo-imaging plate 110. For example, the period of time may be equal to the duration of the null cycle of the photo-imaging plate 110. The duration of the null cycle corresponds to a duration of writing a color separation onto the photo-imaging plate. The period of time may be based on the time that would have been taken to transfer an inked image for the identified print frame. The predetermined period of time may be determined based on the geometries of the printing system and the velocities of the media transport 130. In an example, the media transport 130 is disengaged from the transfer member 120 by lowering the media transport 130. In another example, the media transport 130 is disengaged from the transfer member 120 by raising the transfer member 120.

Delaying the generating of the electrostatic image of the identified print frame and temporarily disengaging the media transport 130 from the transfer member 120 results in no image being transferred by the transfer member 120 across the splice. Instead of the inked image of the identified print frame, the print medium 135, after completion of the printing operation, contains a blank frame spanning across the splice, with the inked image of the identified print frame succeeding the blank frame. Thus no images are printed across areas of the print medium 135 that include a splice, but no images are missed in the final printed sequence.

In an example, the media transport 130 is configured to move the print medium 135 in a predetermined direction relative to the transfer member 120 after the splice-containing print frame has advanced beyond the nip between the transfer member 120 and the media transport 130. The predetermined direction may be a forward direction relative to the transfer member 120. The predetermined direction may be away from the transfer member 120. In other words, once the splice-containing print frame has advanced beyond the disengaged transfer member 120, it does not then move backwards through the nip after the transfer member 120 is re-engaged with the media transport 130. Backward motion of the splice across the transfer member 120 may thereby be prevented after re-engagement of the transfer member 120 with the media transport 130. Thus a splice that has passed beyond the transfer member 120 will not damage the transfer member 120 by backward motion of the splice containing print frame. A print media buffer may be used to prevent backward motion of the splice-containing print medium after the splice has advanced beyond the nip. In an example, the splice is not tracked as it moves along the media path after it has been detected by the splice detector 140.

In some examples, the print processor 150 is configured to identify the print frame by determining a distance of the detected splice from the transfer member 120 when the splice is detected by the splice detector 140. In one example, the splice detector 140 is statically mounted a known or measurable distance from a nip between the transfer member 120 and the media transport 130. Hence, this distance may be stored as a constant in memory. In another example, if a distance between the splice detector 140 and the nip is variable, this may be measured and stored in accessible memory. In an example, the print processor 150 is configured to calculate a sum of successive repeat lengths of pending print frames and identify a print frame whose repeat length, when added to the sum of successive repeat lengths, exceeds the determined distance.

In some examples, the printing system 100 comprises a memory to store the data indicating successive repeat lengths of the pending print frames for use in identifying the print frame from the sequence. An example of a memory is a buffer. If a buffer is used, it may have a minimum length based on the distance between the splice detector 140 and the nip (as discussed above) divided by the minimum repeat length usable by the printing system (e.g. one plus that result rounded-up to the nearest integer).

In an example, the print processor 150 is further configured to determine a projected position of the splice with respect to the identified print frame. Responsive to the determined position being within a predetermined distance of an edge of the identified print frame, the print processor 150 may be configured to send a control signal to the imaging unit 115 to delay generating an electrostatic image for a further print frame. The further print frame is adjacent to the identified pending print frame in the sequence of pending print frames.

In some examples, responsive to a splice being detected by the splice detector 140, the print processor 150 is configured to cause an alarm to activate. For example, a sound may be generated and/or an alert or message may appear on a display of the printing system 100.

In some examples, responsive to a splice being detected by the splice detector 140, the print processor 150 is configured to cause an established printing operation performed by the printing system 100 to be interrupted.

Figure 2A:
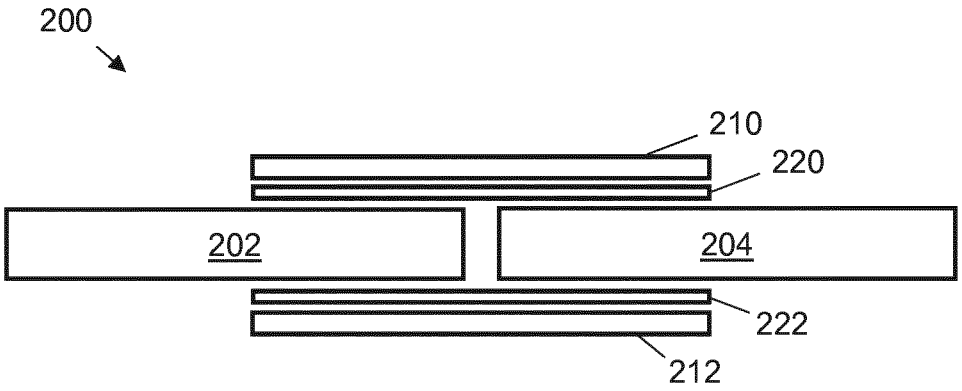
FIG. 2A is a schematic diagram of a portion of a continuous print medium according to an example.

FIG. 2A shows a portion of a continuous print medium 200 according to an example. The continuous print medium may be used in a printing operation, for example an operation performed by printing system 100.

The portion 200 comprises a first medium length 202 and a second medium length 204. The first length 202 and the second length 204 are separate pieces of print medium that are joined together to form a continuous portion of print medium. In the present example, the first length 202 abuts the second length 204. This type of splicing is referred to as "butt splicing". In order to join the lengths 202, 204, tape layers 210, 212 are arranged across the join between the lengths 202, 204. The tape layers 210, 212 are adhered to the lengths 202, 204 using glue layers 220, 222. In the present example, glue and tape layers are applied on both sides of the print medium. In other examples, glue and tape layers are applied on one side of the print medium. In this example, an increased thickness occurs in the region of the splice due to the additional tape and glue layers.

Figure 2B:
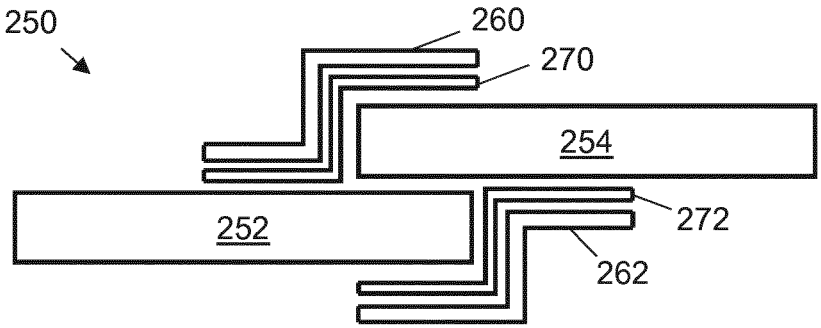
FIG. 2B is a schematic diagram of a portion of a continuous print medium according to an example.

FIG. 2B shows a portion of a continuous print medium 250 according to another example. The continuous print medium may be used in a printing operation, for example an operation performed by printing system 100.

The portion 250 comprises a first medium piece 252 and a second medium piece 254. The first piece 252 and the second piece 254 are separate lengths of print medium that are joined together to form a continuous portion of print medium. In the present example, the first piece 252 overlaps the second piece 254. This type of splicing is referred to as "overlap splicing". In order to fix the pieces 252, 254 together, tape layers 260, 262 are arranged across the overlap between the pieces 252, 254. The tape layers 260, 262 are adhered to the pieces 252, 254 using glue layers 270, 272. In this example, an increased thickness occurs in the region of the splice due to the overlapping of the pieces 252, 254 and the additional tape and glue layers.

Figure 3:
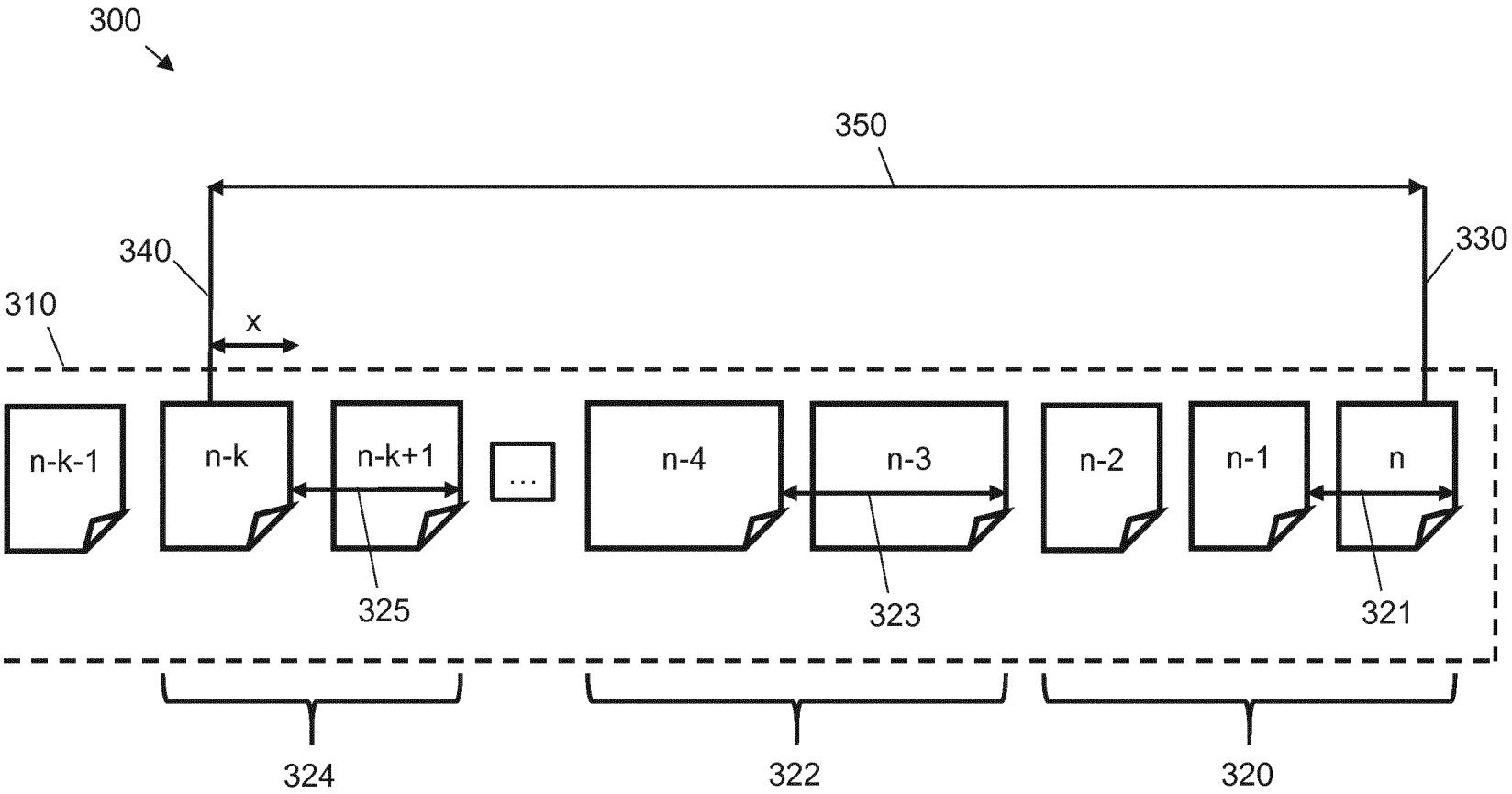
FIG. 3 is a schematic diagram showing a sequence of pending print frames according to an example.

FIG. 3 shows a sequence of pending print frames 300 according to an example. The pending print frames 300 are queued for printing at a given time, for example using printing system 100. For example, for a given pending print frame in the sequence of pending print frames 300, an electrostatic image of the given pending print frame is to be written to the photo-imaging plate 110, and an inked image of the given pending print frame is to be transferred onto the continuous print medium 135 via the transfer member 120.

The pending print frames in the sequence of pending print frames 300 are successive pending print frames. The sequence of pending print frames 300 comprises k+1 print frames. Print frame n in the sequence is the print frame whose inked image is currently being transferred onto the print medium from the transfer member, which is engaged with the print medium at position 330. In the example of FIG. 3, concurrently with the transfer member being engaged at position 330, a splice is detected in the print medium at position 340. For example, a splice detector may be located at position 340 and/or a splice detector with a field of view across the pending print frames 300 may optically detect the splice at position 340. Position 340 is upstream on the media path relative to position 330. Position 340 is located within print frame n−k. That is, an image of print frame n−k is scheduled to be transferred from the transfer member across the detected splice. Print frame n−k is k frames away from print frame n. The positions 330 and 340 may be used to determine a geometric length 350, L, of print medium between the transfer member engagement position 330 and the splice detection position 340. In an example, L 350 is constant. In another example, L 350 varies over time. For example, the transfer member engagement position 330 and/or the splice detection position 340 may change relative to one another, for example due to the dynamics of print media buffers, web guides and/or other buffer-related elements arranged between the splice detector and the transfer member. L may be evaluated at a time at which the splice is detected by the splice detector. That is, L may be uniquely defined at an instant at which the splice is detected by the splice detector. L may be evaluated based on the instantaneous position(s) of the buffer-related elements at the time at which the splice is detected.

In the present example, data associated with the sequence of pending print frames 300 is stored in a buffer 310. In another example, the data associated with the sequence of pending print frames 300 is stored in a cache. In other examples, the data associated with the sequence of pending print frames 300 may be stored in other types of memory, for example different types of volatile or non-volatile memory.

The data associated with the sequence of pending print frames 300 may be data indicating the repeat lengths, $RL_i$, of each of the pending print frames in the sequence 300. Repeat lengths may vary in length between different print frames. In the present example, the sequence of pending print frames 300 comprises several groups of pending print frames each having characteristic repeat lengths. Print frames n, n−1 and n−2 are in a first group 320. Each print frame in the first group 320 has a first repeat length 321. Print frames n−3 and n−4 are in a second group 322. Each print frame in the second group 322 has a second repeat length 323, different from the first repeat length 321. This may be because the first group 320 has smaller images or narrower margins. Print frames n−k+1 and n−k are in a third group 324. Each print frame in the third group 324 has a third repeat length 325. The third repeat length 325 may be different from one or both of the first repeat length 321 and the second repeat length 323. In some examples, each print frame in the sequence of pending print frames 300 has a different repeat length. In some examples, each print frame in the sequence of pending print frames 300 has a same repeat length.

The buffer 310 may be continually updated as a printing operation progresses. Consecutive repeat lengths $RL_n$, $RL_{n-1}$, . . . $RL_{n-k-1}$ may thus be continuously stored and updated in the buffer 310. In an example, the buffer 310 is a constant size. In such an example, the minimum size of the buffer, NB, is given by NB=round-up($L/RL_{min}$)+1, where $RL_{min}$ is the minimum repeat length that is useable in the printing system. In another example, the buffer 310 varies in size over time. For example, the buffer 310 may be configured to store a constant number of repeat lengths.

The print frame that is to be transferred by the transfer member across the splice is identified using the contents of the buffer 310 and the geometric length, L 350. The index n−k of the print frame whose image is to contain the splice is determined using the following equation:

$$\min_k \left\{ L - \sum_{i=n-1}^{n-k} RL_i \right\} < 0.$$

In other words, a sum of successive repeat lengths of pending print frames is calculated, and the print frame whose repeat length, when added to the sum of successive repeat lengths, exceeds L, is identified as the print frame n−k, which is scheduled to be printed across the splice.

In some examples, as well as identifying the print frame that is scheduled to be printed across the splice, the projected position of the splice within the identified print frame is determined. For the lowest k found, the fractional position of the splice within the frame is obtained by evaluating:

$$f(k, x) = \left\{ L - RL_{n-k} \cdot x - \sum_{i=n-1}^{n-k+1} RL_i \right\} = 0.$$

The fractional position, x, of the splice within the frame is in the range 0 to 1, where x is a fraction of the print frame n−k.

In some examples, the projected position of the splice, x, is compared with a splice width threshold parameter, w. The splice width threshold parameter, w, may be indicative of a width of a splice. The splice width threshold parameter, w, may be pre-determined, estimated, calculated and/or measured. In an example, the splice width threshold parameter, w, is a fraction between 0 and 1. In an example, the splice width threshold parameter, w, is used to determine whether print frames adjacent to the identified print frame may be affected by the detected splice, as described below.

In some examples, for example if multiple splices are projected to be within a single pending print frame, x is representative of a vector of all projected splice locations within the print frame, in other words an array of data ordered such that individual items, for example splice locations, can be located with a single index.

In some examples, the geometric length, L, is not used to identify the print frame scheduled to be printed across a splice, for example print frame n−k. The index n−k may be determined by other means, for example if k is a known constant. If a splice is detected whilst print frame n is being printed, successive print frames may be printed until print frame n−k is reached, at which point the web may be disengaged from the transfer member. In other words, the index of the print frame that is projected to be affected by the splice may be determined without knowing L.

Figure 4:
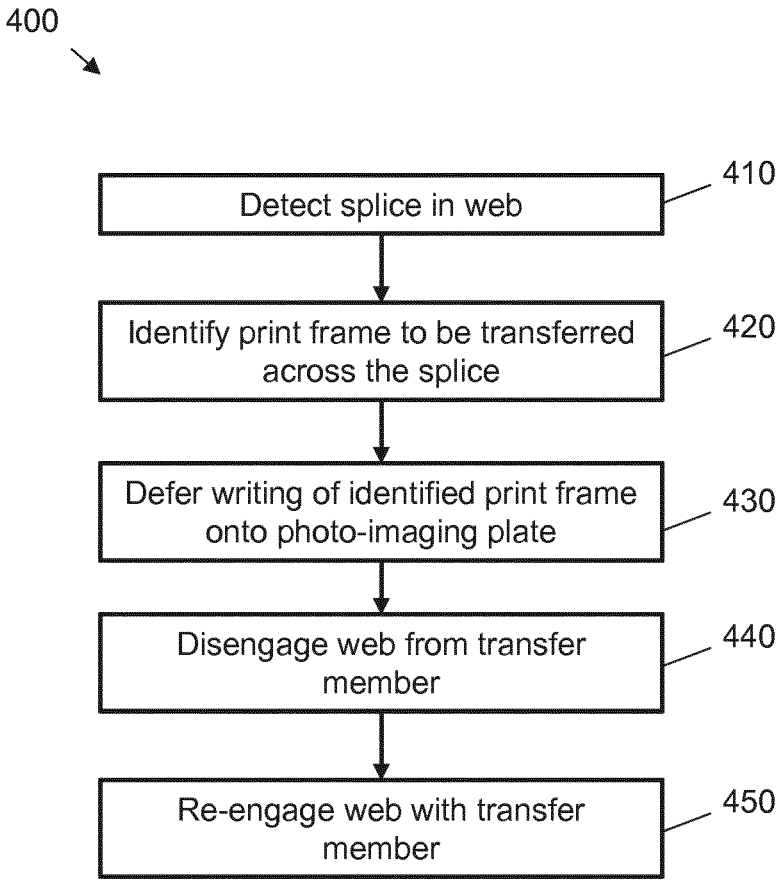
FIG. 4 is a flow chart illustrating a method for operating a printing system according to an example.

FIG. 4 shows a method 400 of operating a printing system according to an example. In some examples, the method 400 is performed by a print processor such as print processor 150. The print processor may perform the method based on instructions retrieved from a computer-readable storage medium. The printing system may comprise printing system 100.

At item 410, a splice is detected in a web being conveyed towards a transfer member of the printing system. The web may be a continuous print medium joined as shown in the examples of FIGS. 2A and 2B.

At item 420, a print frame is identified from a sequence of pending print frames. The identified print frame is scheduled to be transferred from the transfer member across the splice. The print frame is identified using successive repeat lengths of the sequence of pending print frames and a distance of the detected splice from the transfer member. In an example, the successive repeat lengths are stored in a buffer for use in identifying the print frame from the sequence. In an example, a repeat length of at least one of the sequence of pending print frames is different from a repeat length of at least one other of the sequence of pending print frames. In other words, at least some successive repeat lengths may vary across the sequence of pending print frames. This may be the case for a VDP job. In an example, the distance of the detected splice from the transfer member is determined. In an example, the distance of the detected splice from the transfer member is determined for an instance at which the splice is detected. In an example, the distance of the detected splice from the transfer member is uniquely defined at an instance at which the splice is detected.

At item 430, writing of the identified print frame onto a photo-imaging plate of the printing system is deferred. In an example, the photo-imaging plate is mounted onto a cylinder. In an example, writing of the identified print frame onto the photo-imaging plate may be deferred while the mounted photo-imaging plate continues to rotate. In an example, a null cycle of the photo-imaging plate is initiated. In some examples, more than one successive null cycle is initiated. Each null cycle may relate to a different color of a printed image. During a null cycle, no image data is written onto the photo-imaging plate. In another example, exposure of the photo-imaging plate to a set of lasers (i.e. writing of an electrostatic image) is delayed for a predetermined time period, e.g. a time period based on the time it would have taken to expose the identified print frame.

At item 440, following transfer of an image of a print frame preceding the identified print frame, the web is disengaged from the transfer member. During disengagement of the web from the transfer member, the web may be advanced. In an example, the web is advanced by a distance corresponding to a repeat length of the identified print frame.

At item 450, the web is re-engaged with the transfer member so as to transfer an image of the identified print frame to the web from the transfer member after the splice is conveyed beyond the transfer member. The web may be disengaged and re-engaged by temporarily moving a component of a media transport and/or the transfer member. The web may be disengaged for a predetermined time period, e.g. a time period based on the time it would have taken to transfer an inked image the identified print frame. In an example, backward motion of the splice across the transfer member 120 is prevented after the web is re-engaged with the transfer member 120.

Any of items 410 to 450 may be performed repeatedly during an ongoing printing operation performed by the printing system. For example, the web may temporarily disengaged from the transfer member and/or the writing of image data onto the photo-imaging plate may be delayed whenever a splice is detected in the web. This temporary disengagement in relation to the presence of a splice may be in addition to any disengagement enacted to thread the web backwards along a media transport during printing on portions of media that do not contain splices.

Figure 5:
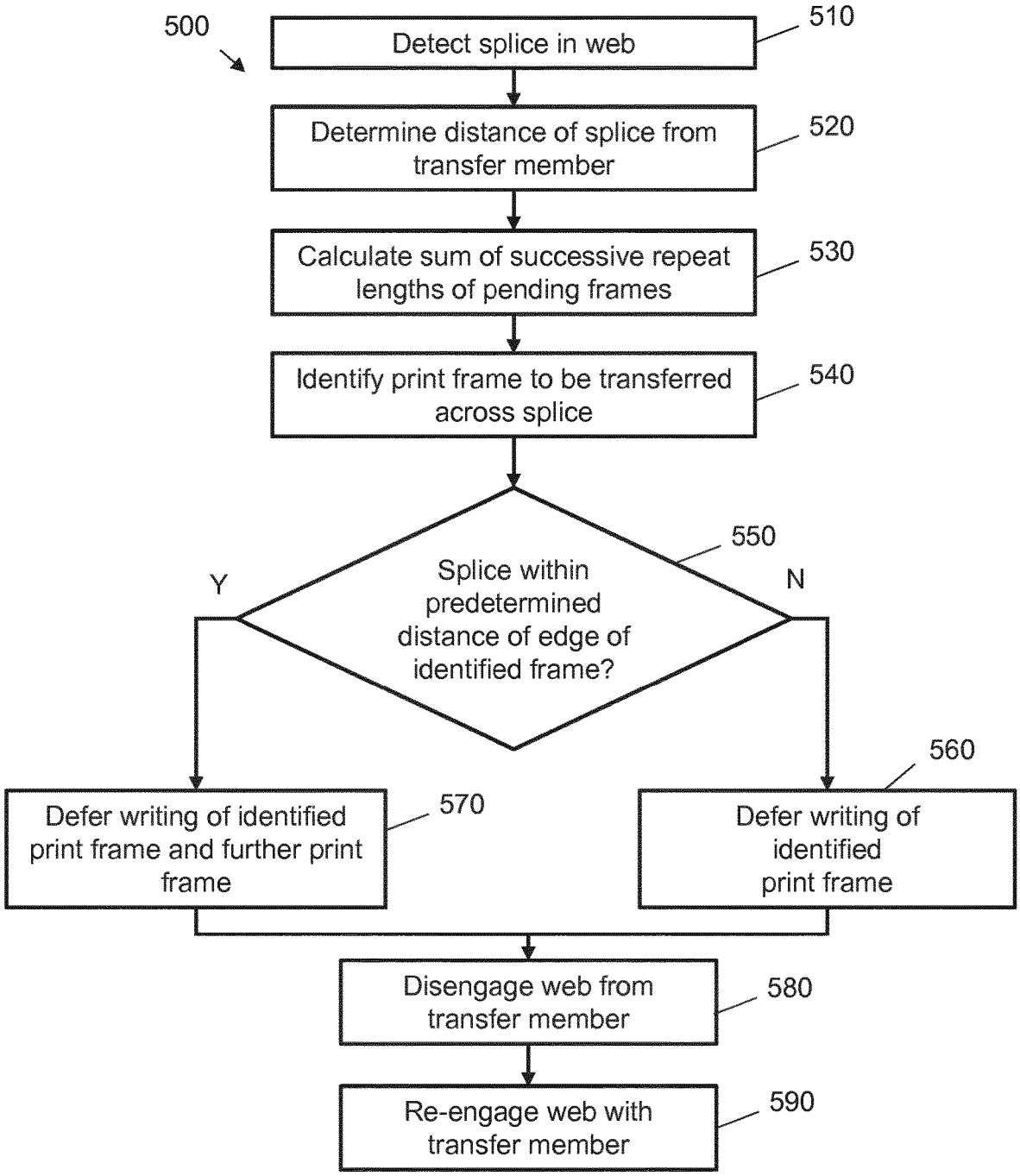
FIG. 5 is a flow chart illustrating a method for operating a printing system according to an example.

FIG. 5 shows a method 500 of operating a printing system according to an example. In some examples, the method 500 is performed by a print processor such as print processor 150.

At item 510, a splice is detected in a web that is being conveyed towards a transfer member of the printing system.

At item 520, a distance of the detected splice from the transfer member is determined.

At item 530, a sum of successive repeat lengths of a sequence of pending print frames is calculated.

At item 540, a pending print frame is identified whose repeat length, when added to the sum of successive repeat lengths, exceeds the determined distance between the detected splice and the transfer member. The identified print frame is thus the print frame that is scheduled to be transferred from the transfer member across the splice.

At item 550, a projected position, x, of the splice with respect to the identified print frame is determined. In an example, a proximity of the splice to an edge of the identified print frame is determined. The proximity to an edge of the identified print frame may be determined relative to a splice width threshold parameter, w.

If it is determined at item 550 that the position of the splice is not within a predetermined distance of an edge of the identified print frame, writing of the identified print frame onto a photo-imaging plate of the printing system is deferred at item 560. For example, if $w<x<1-w$, the splice may be positioned sufficiently far from the edges of the identified print frame so as not to potentially affect other print frames that are adjacent to the identified print frame in the sequence. Consequently, writing of the identified print frame is deferred, but writing of further, adjacent print frames is not deferred.

If it is determined at item 550 that the position of the splice is within a predetermined distance of an edge of the identified print frame or of a further print frame, writing of the identified print frame and of the further print frame onto the photo-imaging plate is deferred at item 570. The further print frame is adjacent to the identified print frame in the sequence of pending print frames. For example, if $x<w$, the splice may be positioned relatively close to the leading edge of the identified print frame, and therefore writing of the identified print frame and of the print frame immediately preceding the identified print frame in the sequence of pending print frames is deferred. If $x>1-w$, the splice may be positioned relatively close to the trailing edge of the identified print frame, and therefore writing of the identified print frame and of the print frame immediately following the identified print frame in the sequence of pending print frames is deferred. In some examples, the projected position of the splice may fall on a seamline between two consecutive print frames. In such cases, writing of both print frames onto the photo-imaging plate may be deferred.

At item 580, the web is disengaged from the transfer member following transfer of an image of a print frame preceding the identified print frame. In an example, the print frame preceding the identified print frame is the print frame that immediately precedes the identified print frame in the sequence of pending print frames. In another example, for example if writing of the print frame immediately preceding the identified print frame onto the photo-imaging plate is deferred, the print frame preceding the identified print frame is a print frame that does not immediately precede the identified print frame. For example, if the identified print frame is print frame $n-k$, the web may be disengaged from the transfer member following transfer of an image of print frame $n-k+1$ or of print frame $n-k+2$. During the disengagement of the web from the transfer member, the web is advanced by at least a repeat length of the identified print frame.

At item 590, the web is re-engaged with the transfer member and the writing of the identified print frame onto the photo-imaging plate is resumed so as to transfer an image of the identified print frame to the web from the transfer member after the splice is conveyed beyond the transfer member. For example, an electrostatic image of the identified print frame may now be generated upon the photo-imaging plate, which causes in turn an inked image to be transferred to the transfer member. During this time the web is re-engaged so that by the time the (delayed) inked image of the identified print frame reaches a nip between transfer member and a media transport, the web is engaged such that the inked image is transferred onto the web at the nip. In an example, if writing of an immediately preceding print frame onto the photo-imaging plate is also deferred, writing of the immediately preceding print frame is resumed before writing of the identified print frame is resumed. In another example, if writing of an immediately following print frame onto the photo-imaging plate is deferred, writing of the immediately following print frame is resumed after writing of the identified print frame is resumed. Consequently, images of the sequence of pending print frames are transferred to the web in their original order, but no images are transferred onto the splice.

In an example, the resumption of writing image data onto the photo-imaging plate occurs prior to the web being re-engaged with the transfer member. In another example, the resumption of writing image data onto the photo-imaging plate occurs prior to the web being disengaged from the transfer member. In a further example, the resumption of writing image data onto the photo-imaging plate occurs after the web is re-engaged with the transfer member. In another example, writing of image data onto the photo-imaging plate is resumed simultaneously with either the disengaging or the re-engaging of the web with the transfer member.

Figure 6:
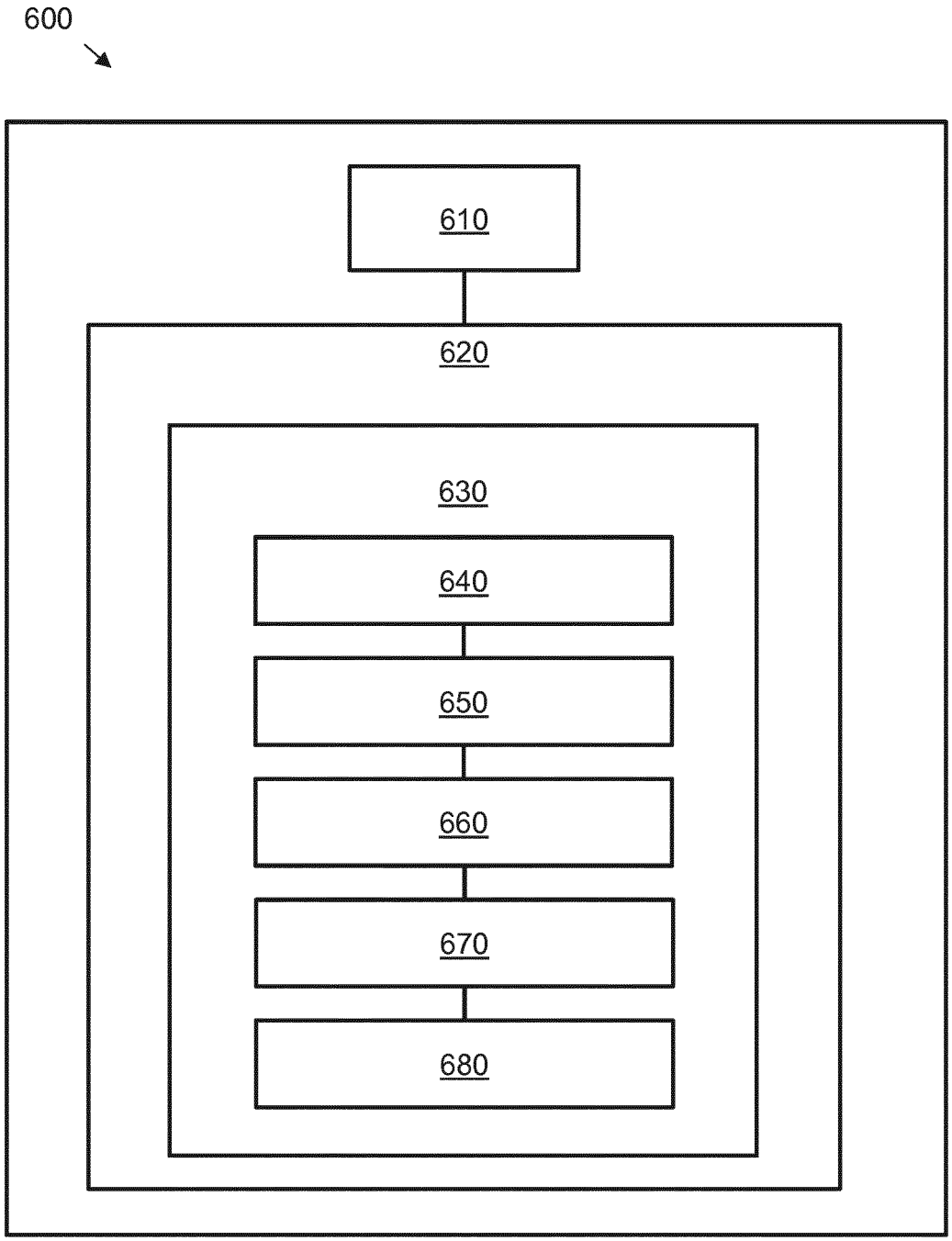
FIG. 6 is a schematic diagram of a processor and a computer readable storage medium with instructions stored thereon according to an example.

FIG. 6 shows example components of a printing system 600, which may be arranged to implement certain examples described herein. A processor 610 of the printing system 600 is connectably coupled to a computer-readable storage medium 620 comprising a set of computer-readable instructions 630 stored thereon, which may be executed by the processor 610. The printing system 600 may comprise a printing system similar to printing system 100. Printing system 600 comprises, or is communicatively coupled to, a splice detector, a memory, an imaging unit and a transfer station. The splice detector and imaging unit may comprise those shown as 140 and 115 in FIG. 1. The memory may comprise a buffer. The transfer station comprises the point at which an inked image is transferred from the transfer member to a web, i.e. to a portion of a continuous print medium.

Instruction 640 instructs the processor 610 to receive a signal from the splice detector indicating a detected splice in a web being conveyed towards the transfer member of the printing system 600. For example, the signal may indicate that a statically-mounted splice detector has detected a splice at its location, and/or may comprise a tracked position of the splice (e.g. image processing performed on an output on an optical sensor). Instruction 650 instructs the processor 610 to obtain a distance of the detected splice from the transfer member. This may be performed directly, e.g. through the receipt of data in the signal identifying the position of the splice with respect to a nip of the transfer station, or indirectly, e.g. by accessing a constant value, or a function where said value is embedded, indicative of the distance between a statically-mounted splice detector and said nip. Instruction 660 then instructs the processor 610 to access successive repeat lengths of a sequence of pending print frames stored in the memory and identify, using said successive repeat lengths and the obtained distance, a print frame from the sequence that is scheduled to be transferred from the transfer member across the splice. Instruction 670 instructs the processor 610 to instruct the imaging unit of the printing system 600 to defer generation of an electrostatic image for the identified print frame. Instruction 670 instructs the processor 610 to instruct a transfer station of the printing system to temporarily disengage the web from the transfer member for a predetermined period of time following transfer of an image of a print frame preceding the identified print frame. This then results in the web re-engaging with the transfer member so as to transfer an image of the identified print frame to the web from the transfer member after the splice is conveyed beyond the transfer member.

Processor 610 can include a microprocessor, microcontroller, processor module or subsystem, programmable integrated circuit, programmable gate array, or another control or computing device. The computer-readable storage medium 620 can be implemented as one or multiple computer-readable storage media. The computer-readable storage medium 620 includes different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. The computer-readable instructions 630 can be stored on one computer-readable storage medium, or alternatively, can be stored on multiple computer-readable storage media. The computer-readable storage medium 620 or media can be located either in the printing system 600 or located at a remote site from which computer-readable instructions can be downloaded over a network for execution by the processor 610.

Certain examples described herein enable an established order of pending print frames to be maintained despite the presence of a splice in a roll of print medium. By identifying print frames that are to be affected by a splice in advance of their printing and delaying writing of image data corresponding to the identified print frames onto a photo-imaging plate, the identified print frames may still be printed in their intended position in a sequence of print frames, with at least one blank frame inserted across the position of the splice.

Certain examples described herein enable a sequence of print frames to be printed on a roll of print medium being conveyed bidirectionally by a media transport. The media transport may convey the print medium bidirectionally so that print frames are printed in a continuous fashion on the print medium. Since the print medium is conveyed bidirectionally, the time for a splice to travel from the splice detector to the transfer member cannot be determined from the distance between the splice detector and the transfer member alone. Successive repeat lengths of the sequence of print frames are used in addition to the distance between the splice detector and the transfer member to identify a print frame that is to be printed across the splice, and to defer writing of image data corresponding to the identified print frame onto a photo-imaging plate. Therefore printing over the splice may be avoided, and the sequence of print frames may be preserved and printed in a continuous fashion.

Certain examples described herein enable a printing system to perform a variable data printing (VDP) operation using a spliced print medium. In a VDP operation, each image in a sequence of images to be printed may be different, and each image in the sequence may have a different repeat length and/or size. By identifying an image in the sequence that is to be affected by a splice, printing the image across the splice is avoided and the original order of images in the sequence is maintained on the final printed medium.

Certain examples described herein reduce the likelihood of a given print job being repeated. In some examples, such as a VDP operation, if a single print frame in a sequence is misprinted or missed, the entire print frame sequence may be reprinted. By delaying writing of image data corresponding to print frames potentially affected by a splice onto a photo-imaging plate, no print frames from a sequence of print frames are skipped or missed. Additionally, since no print frames are printed across the splice, every print frame in the sequence may be printed on splice-free media, thus reducing the likelihood of reprinting some or all of the print frame sequence. By reducing the occurrence of reprints, wastage of print media, inks and other printing materials may also be reduced.

Certain examples described herein enable every image in a sequence of pending images to be printed on splice-free media, thereby improving the visual quality and/or usability of the resulting printed images.

Certain examples described herein enable a printing operation performed on a web of print media to continue uninterrupted despite the presence of a splice in the web. By enabling the printing operation to continue uninterrupted, printer downtime may be reduced, thereby increasing printer productivity.

Certain examples described herein enable a media transport to be temporarily disengaged from a transfer member before a splice in a print medium conveyed by the media transport reaches the transfer member. Since the sudden change in media thickness caused by a splice may damage the transfer member and consequently result in printer downtime, temporarily disengaging the media transport from the transfer member reduces the likelihood of such damage and/or downtime, and increases the lifetime of the transfer member. By preventing impact of the splice with the transfer member, the likelihood of breakage or tearing of the print medium is also reduced. Certain examples described herein enable backward motion of the splice across the transfer member to be prevented after the transfer member has re-engaged with the media transport. By preventing such backward motion, the likelihood of a splice impacting the transfer member is reduced.

Certain examples described herein enable digital offset printing operations to be performed on a web of media comprising several separate lengths of media that are spliced together. Such a web of media may be cheaper compared to a web of media comprising a single, splice-free roll of media. Therefore operating costs may be reduced.

Certain examples described herein enable splices in a roll of continuous print media to be detected and compensated for automatically during a print job, without a human operator to observe and/or intervene in the printing operation.

Certain examples described herein enable uninterrupted continuous printing onto a roll of print medium. By identifying print frames that are to be affected by a splice in advance of their printing and delaying writing of image data corresponding to the identified print frames onto a photo-imaging plate, the identified print frames may still be printed in their intended position in a sequence of print frames.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing system comprising:
a photo-imaging plate;
an imaging unit to generate an electrostatic image of a print frame on the photo-imaging plate;
a transfer member to receive an inked image of the print frame from the photo-imaging plate;
a media transport to move a continuous print medium relative to the transfer member to enable the transfer member to transfer the inked image onto the continuous print medium;
a splice detector to detect a splice in the continuous print medium; and
a print processor to generate control signals for the imaging unit and the media transport,
wherein, responsive to detection of the splice by the splice detector, the print processor is configured to:
identify a print frame in a sequence of pending print frames based on data indicating successive repeat lengths of the pending print frames,
send a control signal to the imaging unit to delay generating the electrostatic image for the identified print frame, and
send a control signal to the media transport to temporarily disengage from the transfer member following transfer of an inked image of a print frame preceding the identified print frame and to advance the continuous print medium by a predetermined distance.

2. The printing system of claim 1, wherein the predetermined distance is a repeat length of the identified print frame.

3. The printing system of claim 1, wherein the identified print frame is a given print frame, and wherein the print processor is configured to:
determine a distance of the detected splice from the transfer member when the splice is detected by the splice detector;
calculate a sum of successive repeat lengths of pending print frames; and
identify the given print frame whose repeat length, when added to the sum of successive repeat lengths, exceeds the determined distance.

4. The printing system of claim 1, wherein, responsive to the detection of the splice by the splice detector, the print processor is configured to:
determine a projected position of the splice with respect to the identified print frame; and
responsive to the determined projected position being within a predetermined distance of an edge of the identified print frame, send a control signal to the imaging unit to delay generating an electrostatic image for a further print frame, the further print frame being adjacent to the identified print frame in the sequence of pending print frames.

5. The printing system of claim 1, wherein, responsive to the detection of the splice by the splice detector, the print processor is configured to initiate a null cycle of the photo-imaging plate, during which no image data is written onto the photo-imaging plate.

6. The printing system of claim 1,
wherein the media transport is to move the continuous print medium bidirectionally relative to the transfer member, and
wherein the splice detector is to detect the splice if the splice is moving in a first direction towards the transfer member, and the splice detector is not detect the splice if the splice is moving in a second direction different from the first direction.

7. The printing system of claim 1, comprising a memory to store the data indicating the successive repeat lengths of the pending print frames for use in identifying the identified print frame in the sequence.

8. A method comprising:
detecting a splice in a web being conveyed towards a transfer member of a printing system;
identifying, by the printing system using successive repeat lengths of a sequence of pending print frames and a distance of the detected splice from the transfer member, a print frame from the sequence, the identified print frame to be transferred from the transfer member across the splice, wherein a repeat length of a given pending print frame of the pending print frames is a distance from a point in the given pending print frame to a same point in a following pending print frame of the pending print frames;
deferring, by the printing system, writing of the identified print frame onto a photo-imaging plate of the printing system;
disengaging the web from the transfer member following transfer of an image of a print frame preceding the identified print frame; and
re-engaging the web with the transfer member so as to transfer an image of the identified print frame to the web from the transfer member after the splice is conveyed beyond the transfer member.

9. The method of claim 8, comprising, during disengagement of the web, advancing the web by a distance corresponding to a repeat length of the identified print frame.

10. The method of claim 8, comprising, after re-engagement of the web with the transfer member, preventing the splice from moving backwards across the engaged transfer member.

11. The method of claim 8, wherein the identified print frame is a given print frame, and the method comprises:
determining the distance of the detected splice from the transfer member;
calculating a sum of the successive repeat lengths of the pending print frames of the sequence; and
identifying, as the given print frame, a pending print frame whose repeat length, when added to the sum of the successive repeat lengths, exceeds the determined distance.

12. The method of claim 8, comprising:
determining a projected position of the splice with respect to the identified print frame; and
responsive to the determined projected position being within a predetermined distance of an edge of the identified print frame or a further print frame, deferring writing of the further print frame onto the photo-imaging plate, the further print frame being adjacent to the identified print frame in the sequence of pending print frames.

13. The method of claim 8, wherein a repeat length of at least one of the sequence of pending print frames is different from a repeat length of at least one other of the sequence of pending print frames.

14. The method of claim 8, comprising initiating, responsive to detecting the splice, at least one null cycle of the photo-imaging plate, during which no image data is written onto the photo-imaging plate.

15. A non-transitory computer-readable storage medium comprising instructions that when executed cause a printing system to:

receive a signal from a splice detector indicating a detected splice in a web being conveyed towards a transfer member of the printing system;

obtain a distance of the detected splice from the transfer member;

access a memory storing successive repeat lengths of a sequence of pending print frames and identify, using the successive repeat lengths and the obtained distance, a print frame from the sequence, the identified print frame scheduled to be transferred from the transfer member across the splice, the identified print frame to be transferred from the transfer member across the splice, wherein a repeat length of a given pending print frame of the pending print frames is a distance from a point in the given pending print frame to a same point in a following pending print frame of the pending print frames;

instruct an imaging unit of the printing system to defer generation of an electrostatic image for the identified print frame; and instruct a transfer station of the printing system to temporarily disengage the web from the transfer member for a predetermined period of time following transfer of an image of a print frame preceding the identified print frame while maintaining advance of the web.

16. The printing system of claim 7, wherein the memory is to further store the sequence of pending print frames, and the print processor is configured to identify the identified print frame from the sequence of pending print frames stored in the memory.

17. The printing system of claim 1, wherein the transfer member and the media transport together define a nip through which the continuous print medium passes.

18. The printing system of claim 1, wherein the inked image transferred from the photo-imaging plate to the transfer member is based on ink applied to a portion of the photo-imaging plate.

19. The printing system of claim 1, wherein the control signal to the media transport is to cause movement of the media transport to move away from the transfer member.

20. The method of claim 8, wherein the disengaging of the web from the transfer member comprises moving a media transport that moves the web away from the transfer member.

* * * * *